United States Patent [19]

Coles

[11] 4,009,633

[45] Mar. 1, 1977

[54] ELECTRONIC MUSICAL INSTRUMENT

[76] Inventor: Donald K. Coles, 2505 Capitol Ave., Fort Wayne, Ind. 46806

[22] Filed: Oct. 14, 1975

[21] Appl. No.: 622,218

Related U.S. Application Data

[63] Continuation-in-part of Ser. No. 553,798, Feb. 27, 1975, and a continuation-in-part of Ser. No. 538,012, Jan. 2, 1975, abandoned, which is a continuation-in-part of Ser. No. 496,806, Aug. 12, 1974, Pat. No. 3,943,811.

[52] U.S. Cl. ..... 84/1.01; 84/423; 84/451; 84/470

[51] Int. Cl.[2] ..... G10H 1/00; G10H 5/02

[58] Field of Search ..... 84/1.01, 423, 428, 445, 84/451, 470, 478, DIG. 11

[56] References Cited

UNITED STATES PATENTS

| | | | |
|---|---|---|---|
| 3,023,659 | 3/1962 | Bode | 84/445 |
| 3,030,848 | 4/1962 | Wick | 84/445 |
| 3,674,907 | 7/1972 | Derry | 84/1.01 |
| 3,800,060 | 3/1974 | Hallman, Jr. | 84/1.01 X |
| 3,824,325 | 7/1974 | Obayashi et al. | 84/1.01 |
| 3,845,685 | 11/1974 | Coles | 84/451 |
| 3,865,004 | 2/1975 | Coles | 84/423 |
| 3,877,337 | 4/1975 | Obayashi et al. | 84/1.01 |
| 3,910,149 | 10/1975 | Obayashi | 84/1.01 |
| 3,929,052 | 12/1975 | van der Wal | 84/DIG. 11 |
| 3,933,072 | 1/1976 | van der Wal et al. | 84/1.01 |

*Primary Examiner*—Stanley J. Witkowski

[57] ABSTRACT

The organ is designed to play six-tone musical scales, which lead naturally to a simple and easily learned system of hexatonic notation. A scale selector apparatus can be set to make different hexatonic scales playable on the front digitals of the keyboard. For most advantageous use of the instrument, music should be written in or translated into hexatonic notation. The instrument can also be used to play conventionally written music, by using the scale selector apparatus to translate into the conventional diatonic scale.

A hexatonic scale selector switch operates on the top octave of tones; lower tones are derived from the top octave by means of chains of frequency dividers. The association of tones with digitals will be correct in lower octaves of the keyboard, provided that all the musical scales have the same number of tones per octave. For translation to the diatonic scale, it is necessary to use a second scale selector switch operating on the outputs from the chains of frequency dividers.

7 Claims, 17 Drawing Figures

FIG 8
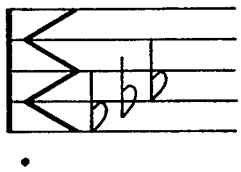
FIG 9
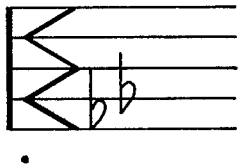
FIG 11
| FREQ. DIV. OUTPUT STAGE | FREQUENCY DIVIDER INPUTS | | | | | | | | | | | |
|---|---|---|---|---|---|---|---|---|---|---|---|---|
| | 1 C | 2 C# | 3 D | 4 D# | 5 E | 6 F | 7 F# | 8 G | 9 G# | 10 A | 11 A# | 12 B |
| 1 | 61 | | | | | | | | | | | |
| 2 | 49 | 50 | 51 | 52 | 53 | 54 | 55 | 56 | 57 | 58 | 59 | 60 |
| 3 | 37 | 38 | 39 | 40 | 41 | 42 | 43 | 44 | 45 | 46 | 47 | 48 |
| 4 | 25 | 26 | 27 | 28 | 29 | 30 | 31 | 32 | 33 | 34 | 35 | 36 |
| 5 | 13 | 14 | 15 | 16 | 17 | 18 | 19 | 20 | 21 | 22 | 23 | 24 |
| 6 | 1 | 2 | 3 | 4 | 5 | 6 | 7 | 8 | 9 | 10 | 11 | 12 |
FIG 12
| FREQ. DIV. OUTPUT STAGE | FREQUENCY DIVIDER INPUTS | | | | | | | | | | | |
|---|---|---|---|---|---|---|---|---|---|---|---|---|
| | 1 C | 2 C# | 3 D | 4 D# | 5 E | 6 F | 7 F# | 8 G | 9 G# | 10 A | 11 A# | 12 B |
| 1 | | | | | | | | | | | | |
| 2 | 53 | 54 | 55 | 56 | 57 | 59 | 60 | 61 | | | | |
| 3 | 39 | 40 | 41 | 42 | 43 | 45 | 46 | 47 | 48 | 49 | 50 | 51 |
| 4 | 25 | 26 | 27 | 28 | 29 | 31 | 32 | 33 | 34 | 35 | 36 | 37 |
| 5 | 11 | 12 | 13 | 14 | 15 | 17 | 18 | 19 | 20 | 21 | 22 | 23 |
| 6 | | | | | 1 | 3 | 4 | 5 | 6 | 7 | 8 | 9 |

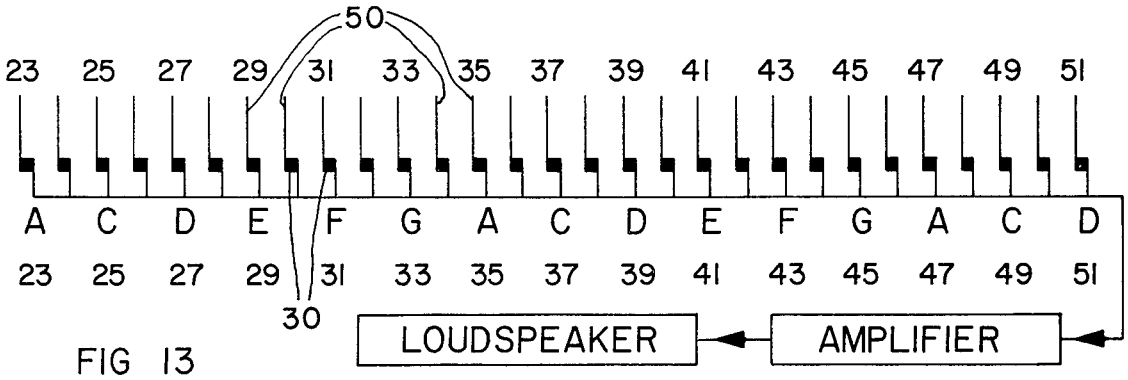
FIG 13
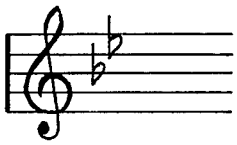
FIG 14
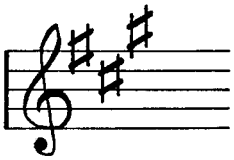
FIG 15
FIG 16
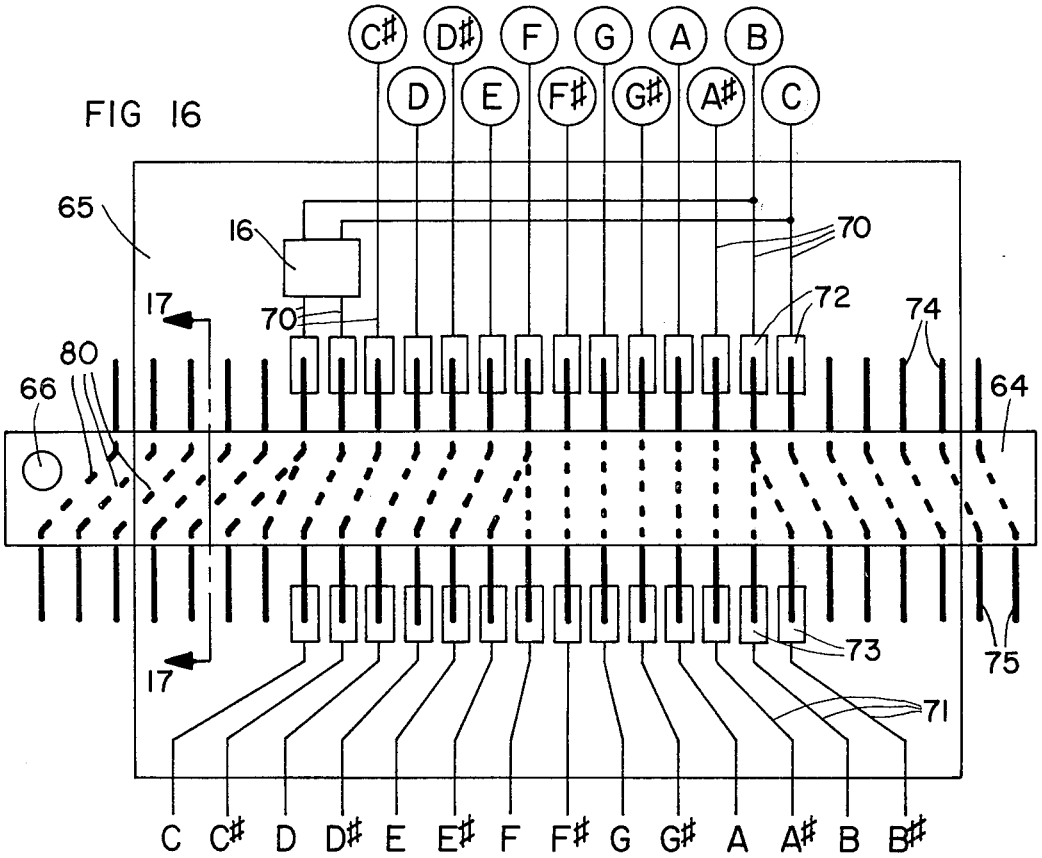
FIG 17
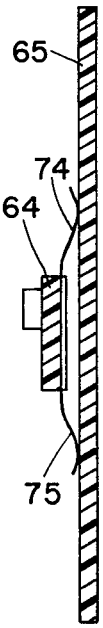

ELECTRONIC MUSICAL INSTRUMENT

CROSS REFERENCE TO RELATED APPLICATION

This is a continuation-in-part of my copending U.S. patent application no. 496,806 filed Aug. 12, 1974, now U.S. Pat. No. 3,943,811, application no. 538,012 filed Jan. 2, 1975, now abandoned, and application no. 553,798 filed Feb. 27, 1975.

BACKGROUND OF THE INVENTION

1. Field of the Invention

The improved scale selector provides means for selecting out of the 12 tones per octave those needed for different musical scales. Musical scales selected can have different numbers of tones per octave.

2. Description of the Prior Art

When children are learning sight reading, they become confused by the traditional musical notation which represents a particular tone sometimes on a line of a staff, and at other times in a space between the lines. More confusion is caused when reading on the treble staff is transferred to the bass staff, where the lines and spaces are differently labeled.

Any six-tone musical scale leads naturally to a simple notation compatible with five-line staves, which we may give the generic name hexatonic notation. In hexatonic notation, three of the notes are always assigned to lines, the other three notes are always assigned to spaces. Moreover, the labeling of the lines and spaces in the upper five-line staff is the same as the labeling in the lower five-line staff. The resulting mental images of tones interact constructively, instead of destructively.

Starting in the past century, there has been interest in the whole tone scale, which has six tones with a musical interval of two semitones between consecutive tones in the scale. This scale has special virtues but also disadvantages; up to this time no attempt to promote the whole tone keyboard has been widely accepted. Since the tones of the whole tone scale are uniformly spaced, there is no natural basis for development of tonality, or of loyalty to a particular tonal center. Furthermore, the whole tone scale lacks the musical intervals of fourths and fifths which are basic to the early development of music appreciation.

Six-tone scales other than the whole tone scale, which I call "irregular" hexatonic scales, must inherently include at least one musical interval of three or more semitones. One such scale is the hexachord, characterized by intertone invervals of 2-2-1-2-2-3 semitones. Since the hexachord consists of the first six tones of the major mode of the diatonic scale, there is little difficulty in learning the hexachord scale.

For teaching music to beginners, I have found that the hexachord scale is better than the whole tone scale. The hexachord's "irregularity" serves as a focal point in tonal development, and the hexachord scale includes intervals of fourths and fifths. In my standard hexachord notation, tones corresponding to lines of the staff constitute the C major triad; tones corresponding to the spaces constitute the D minor triad. Thus hexachord notation allows a fixed and intimate association between the sounds of music and their representation.

With a keyboard containing several octaves of hexachord scale, it is possible to play on six adjacent front digitals any one of the sequences C,D,E,F,G,A (major mode), A,C,D,E,F,G (minor mode), G,A,C,D,E,F (dominant mode), F,G,A,C,D,E (subdominant mode), E,F,G,A,C,D (fifth mode) and D,E,F,G,A,C (sixth mode). I include all six of these sequences as different cyclic modes of the same hexachord scale.

As described in my copending patent application no. 553,798, the diatonic scale and the hexachord scale are members of a quintessential series of musical scales which emphasize the musical interval of a fifth (and its complement, the fourth). The series includes eleven member scales, all containing different numbers of tones per octave. Any member of the series can be united with an identical scale pitched a fifth higher to form a single member scale with only one additional tone per octave. Thus a hexachord scale based on C can be united with another hexachord scale based on G to form a diatonic scale based on C, with seven tones per octave.

In the same way, a diatonic scale based on C can be united with another diatonic scale based on G to form an octachord scale, with eight tones per octave. This octachord scale, obtained by adding the F sharp tone to the diatonic scale based on C, is a most common extension of the diatonic scale. Going downward in the series of scales, the hexachord scale contains two tonal pentatonic scales spaced by a fifth, and each tonal pentatonic scale contains two identical tetratones spaced by a fifth.

While the quintessential series of scales is unique in the equitempered system, the diatonic member of the series is not itself unique. Furthermore, the seven-tone diatonic scale is not well suited to a notational system which uses the lines and spaces of a staff, for seven is an odd number. In notation based on an odd number, a particular note will be associated with a line in one octave and with a space in the adjacent octaves. On the other hand, in notation based on the hexachord or octachord scale, a particular note will be associated with a line in all octaves, or with a space in all octaves.

The hexachord scale contains all melodies included in the tonal pentatonic scale plus many other familiar melodies, such as Annie Laurie, Loch Lomond, My Bonnie Lies Over the Ocean, Michael, Row the Boat Ashore, Drink to Me Only, Long Long Ago, Rock of Ages, Nearer My God to Thee, Kum Ba Ya, Were You There?

The octachord scale contains all melodies within the hexachord and diatonic scales plus many other melodies, such as the authorized versions of the national anthems of the United States, the Soviet Union, Germany, Austria; Rule Britannia, The Maple Leaf Forever, Columbia the Gem of the Ocean, Blue Bells of Scotland, Killarney, Santa Lucia, Love's Old Sweet Song, Toyland, There is a Tavern in the Town, Work for the Night is Coming, Flow Gently Sweet Afton, Abide With Me, Onward Christian Soldiers, Come Ye Disconsolate. These representative melodies are in the major mode of the octachord scale, defined by the sequence of intertone intervals 2-2-1-1-1-2-2-1 semitones.

Other cyclic modes of the octachord scale include many other well known melodies. The Song of the Volga Boatman, for example, is in the dominant minor mode defined by the intertone intervals 1-1-1-2-2-1-2-2 semitones.

Either the hexacord or the octachord scale naturally provides a fixed association between a tone in the scale and its visual representation in a musical staff. The hexachord has an advantage over the octachord in compatibility with the traditional system of two five-line staves, for hexachord labeling of lines and spaces in the lower five-line staff is identical with that in the upper five-line staff. Thus the two visualizations reinforce each other, instead of clashing.

Compatibility with five-line staves enables a musician trained in the hexatonic notation to play music printed in the conventional seven-note notation, provided that he is playing an instrument with a suitable scale selector switch.

Trained musicians may wish to take advantage of the special virtues of the whole tone scale, in which all chords are played with only two different fingerings. My scale selector switch makes this possible.

Scale selecting switches are disclosed in my U.S. Pats. Nos. 3,141,371 and 3,943,811 and in my copending applications 507,118 filed Sept. 18, 1974 and 553,798 filed Feb. 27, 1975. An absolute pitch changing apparatus for changing the musical output to a pitch higher or lower than that specified by the composer is disclosed in U.S. Pat. No. 3,023,659 — BODE. This apparatus couples a set of primary tone generator circuits to a set of chains of frequency divider circuits, which in turn provide secondary tones for all the digitals of the keyboard. Uniform changes in absolute pitch in the set of primary tone generator circuits are reproduced in the frequency dividers.

SUMMARY OF THE INVENTION

My invention is an improved scale selector apparatus for an organ or electric piano which is adapted to play hexatonic scales on the front digitals. The keyboard normally contains six front digitals per octave span, where the length of an octave span is defined as the center-to-center distance between two digitals which control tones an octave apart. The number of back digitals per octave span is also six, the back digitals alternating with the front digitals.

The scale selector allows the player trained on the hexatonic instrument to play also music written in the conventional diatonic scale. When a player trained on my hexatonic instrument must play music written in the conventional way, he sets the scale selector apparatus to the diatonic state and continues playing as before. He need not learn different labels for the lines and spaces of the staves.

My improved scale selector apparatus has a set of 12 primary tone generator circuits providing tones of the equitempered scale, and twelve chains of frequency divider circuits which provide secondary tones for the digitals of the keyboard. Individual primary tone generator circuits are coupled to individual inputs of the twelve chains of frequency dividers via a first scale selector switch, for selecting between musical scales with the same number of tones per octave.

All the outputs from the chains of frequency dividers are coupled to the apparatus output leads via a second scale selector switch, which is necessary when selecting between scales with different numbers of tones per octave. Tone signals from the apparatus output leads are coupled to digitals of the keyboard.

When the first switch is in its standard state, the apparatus as a whole can be in its first or second switch state, depending on the state of the second scale selector switch. The first apparatus switch state provides tones of the whole tone scale for the front digitals of the keyboard. The second apparatus switch state provides tones of the diatonic scale for front digitals of the keyboard.

Other apparatus switch states are obtained by other states of the first scale selector switch. In the preferred embodiment, the other apparatus switch states provide different musical scales having six tones per octave. All these six-tone scales are transmitted on the same subset of six chains of frequency divider circuits.

BRIEF DESCRIPTION OF THE DRAWINGS

FIGS. 8 and 9 shows hexatonic scale signatures.

FIGS. 11,12 tabulate the connections in FIG. 10.

FIG. 13 shows the array of digital switches.

FIGS. 14,15 show diatonic key signatures.

FIGS. 16,17 show my key selector switch.

DESCRIPTION OF THE PREFERRED EMBODIMENT

Figure 1:
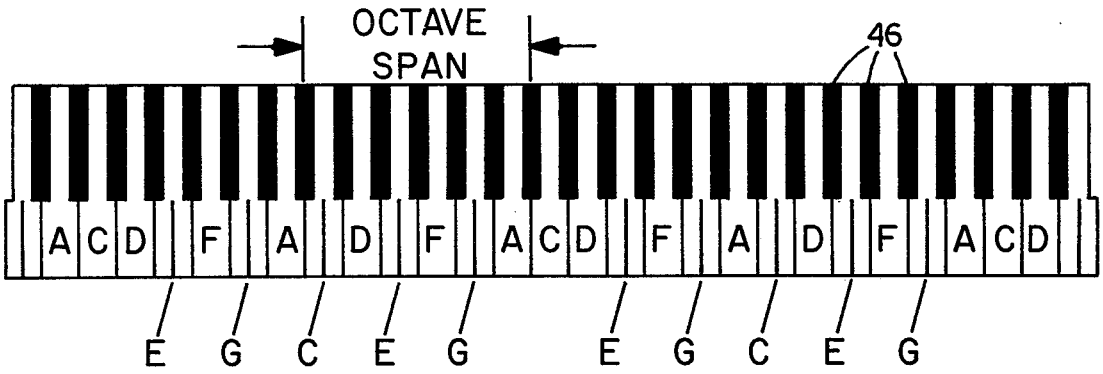
FIG. 1 shows the keyboard of my musical instrument with hexatonic labels for the front digitals.

Referring to FIG. 1, my hexatonic keyboard has six front digitals and six back digitals per octave span. To avoid ambiguity, I define the octave span as the center-to-center distance between digitals which control tones an octave apart. Although defined as a center-to-center distance, this distance may of course be measured between any corresponding points of the two digitals, or between the cracks to the immediate left of the digitals.

In order to avoid other ambiguities, I generally use the terms "tone" and "pitch" in a relative way to describe a musical sound relative to other tones in a musical scale. When I mean pitch in an absolute sense, I use the specific term "absolute pitch". A musical scale is characterized by the intertone intervals between its adjacent tones, not by their absolute pitch.

In counting the number of tones per octave of a musical scale, the tone an octave above the starting tone is not counted. Thus the conventional diatonic scale is said to be a seven-tone scale.

In defining a musical scale by its sequence of intertone intervals, the number of specified intertone intervals is equal to the number of tones per octave, the last intertone interval being measured between the top tone within the octave and that tone which is one octave above the lowest tone of the scale. Thus the major mode of the diatonic scale is defined by the intertone intervals 2-2-1-2-2-2-1 semitones.

I reserve the term "note" for the symbol itself (such as C or D) which is used to specify a digital and the tone it activates. When a staff is used to record music in a particular system of notation, each musical tone is indicated by a note on the staff.

Starting at the left of the octave span shown in FIG. 1, the six front digitals included in the octave span are labeled C,D,E,F,G,A. The notes C,E,G always fall on lines of the upper and lower staves, the notes D,F,A always fall on spaces between the lines. FIG. 1 shows landmarks directly representative of the five-line staves engraved on the front digitals. Back digitals 46 alternate with front digitals.

Figure 2:
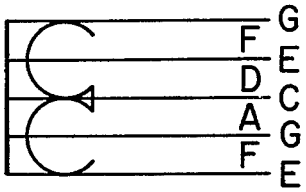
FIGS. 2 and 3 show hexachord scale signs and whole tone scale signs respectively.
Figure 3:
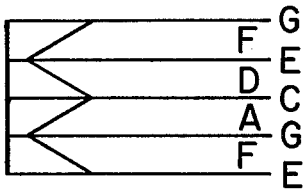

FIG. 2 shows a scale sign used for the hexachord notation, and the notes assigned to the lines and spaces of the five-line staff. FIG. 3 shows the scale sign used for the whole tone notation, and the same assignment of notes to the lines and spaces of the staff.

Figure 4:
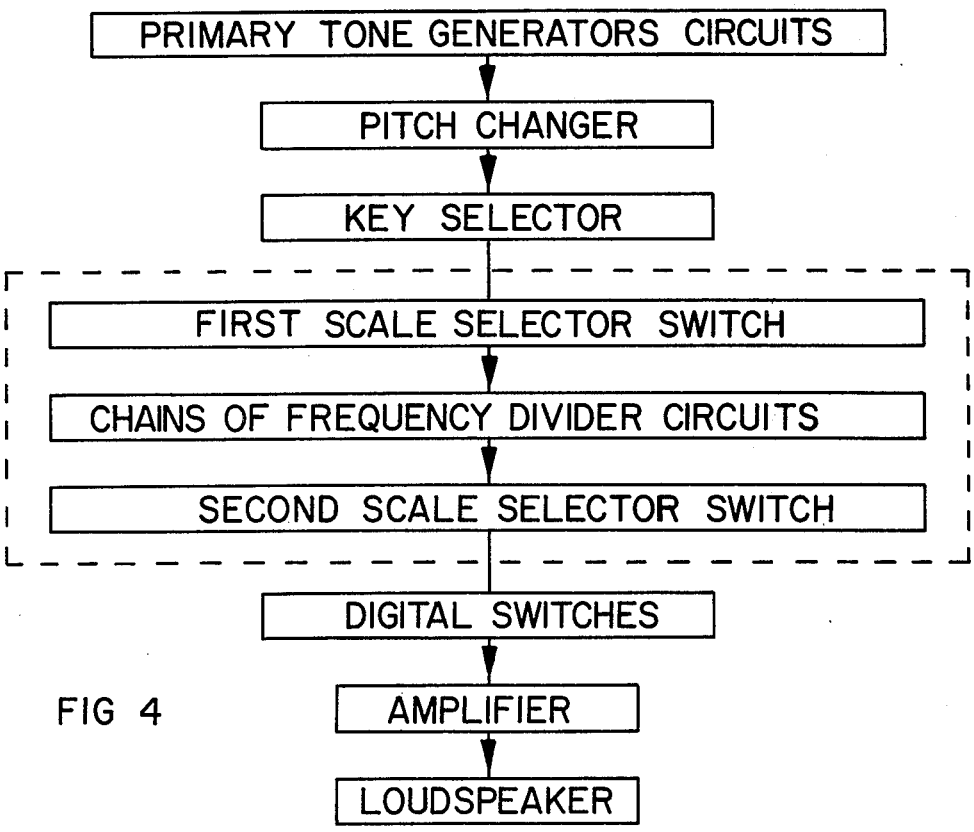
FIG. 4 is a block diagram showing the relationship of my scale selection apparatus to other parts of my musical instrument.
Figure 5:
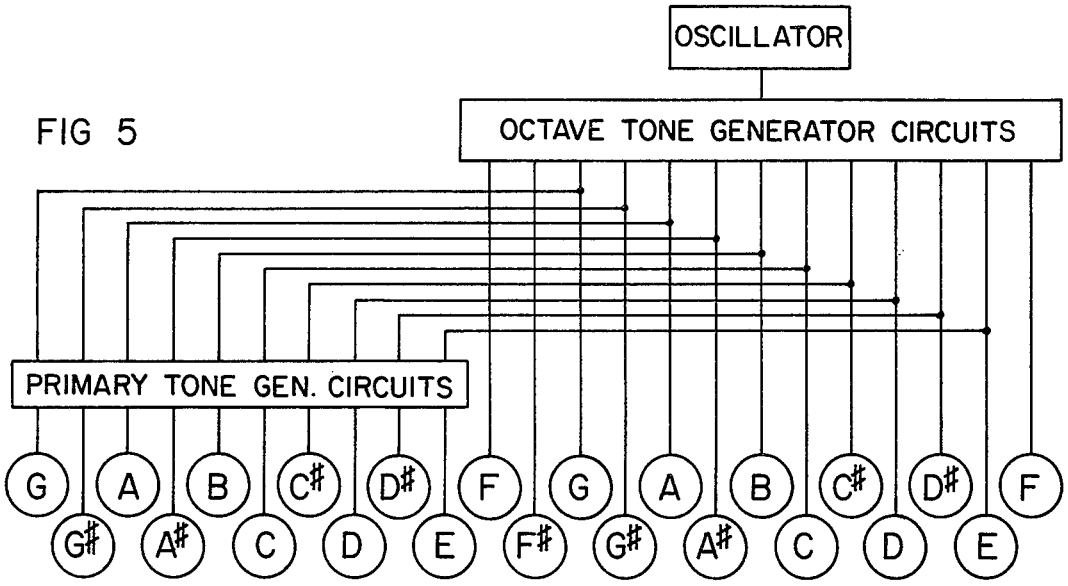
FIG. 5 shows my tone generation apparatus.

FIG. 4 is a block diagram showing the relationship of my scale selector apparatus to other parts of my musical instrument. The primary tone generator circuits shown in FIG. 4 are diagrammed in FIG. 5. Referring to FIG. 5, the oscillator is crystal controlled, type CO-236,manufactured by Vectron Laboratories, Inc. This oscillator has a frequency of 1.335 MHz. The top octave generator in FIG. 5 is type MK240, manufactured by the Mostek Corporation. This divides the input frequency by 239, 253, 268, 284, 301, 319, 338, 358, 379, 402, 426, 451, and 478, producing 13 tones ranging from F at 2794 Hz to F at 5588 Hz. The primary tone generator circuits shown in FIG. 5 produce ten more tones by frequency division of ten tones from the top octave. This extends the range of tones down to G at 1568 Hz. The primary tone generator circuits are type CD4027A flip-flops, manufactured by the RCA Corporation.

Referring again to FIG. 4, the pitch changer switch shown is of the type disclosed by Bode in U.S. Pat. no. 3,023,659. From the 23 original tone generator circuits the pitch changer selects 12 primary tone generator circuits. These are labeled in order of increasing pitch by ordinal numbers M, where M ranges from one to 12 . In the standard pitch changer position, the 12 output tones range from C flat at 2217 Hz to C at 4186 Hz.

Figure 7:
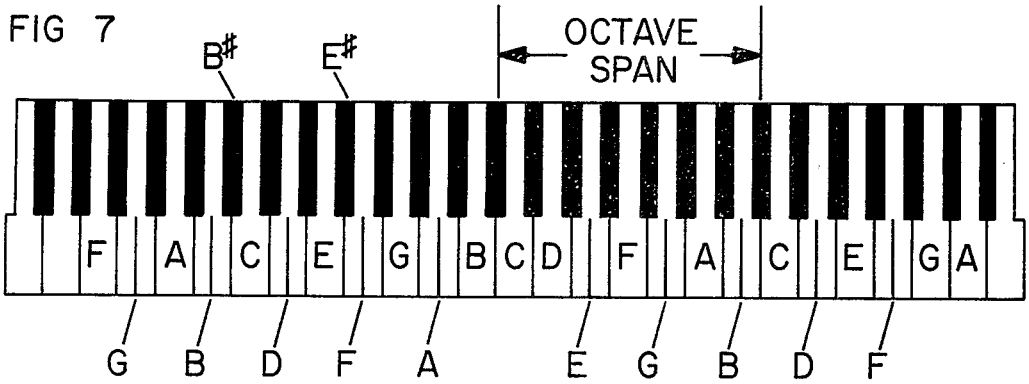
FIG. 7 shows diatonic labels for the keyboard of my musical instrument.

FIG. 7 shows diatonic labels for the keyboard. A player trained in the hexatonic system need not learn these labels (or any labels); he can play either hexatonic or conventional music by observing the relationship of the written notes to the five-line staves engraved on the keyboard.

The key selector shown in FIG. 4 is an aid to players inexperienced in diatonic music. It can be set to actuate the tone substitutions called for in the key signatures of diatonic music. This switch is described later.

In FIG. 4, scale selector apparatus is shown enclosed within a dotted rectangle. This apparatus comprises a first scale selector switch, at least twelve chains of cascaded frequency divider circuits, and a second scale selector switch. The twelve chains of frequency divider circuits have their input leads coupled to the output leads of the first scale selector switch. Each chain includes seven cascaded frequency divider circuits which produce secondary tones for the digitals of the keyboard.

Sixty one outputs from the frequency divider circuits are connected to the input leads of the second scale selector switch. The output leads from this second scale selector switch are the output leads from the whole scale selector apparatus.

Figure 6:
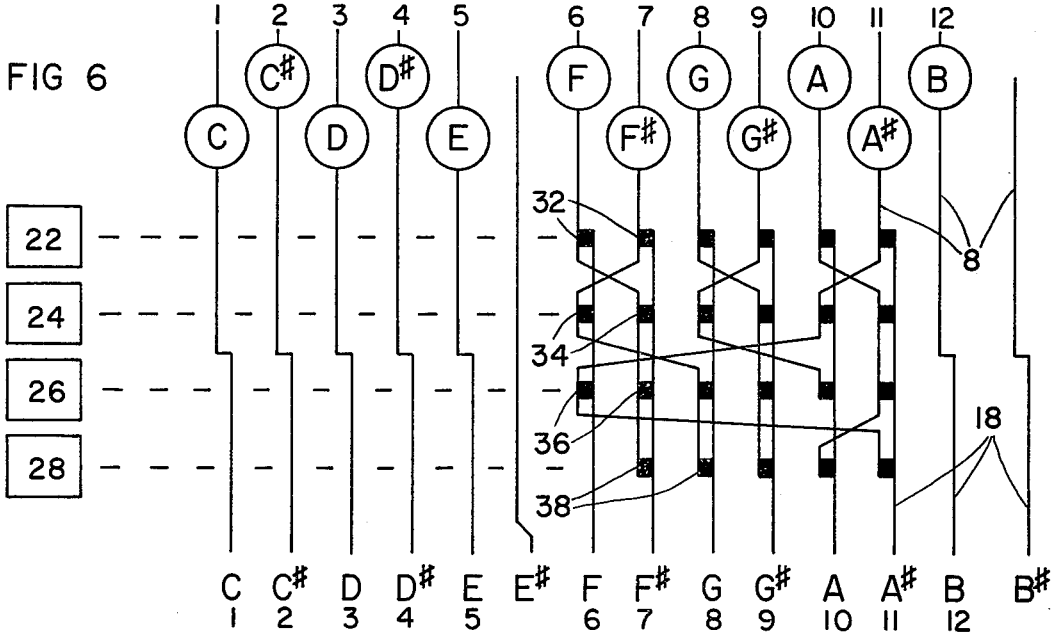
FIG. 6 shows my first scale selector switch for selecting between hexatonic musical scales.

We refer now to FIG. 6, which is a wiring diagram of the first scale selector switch shown in FIG. 4.

Pushbuttons 22,24,26,28 are interlocked so that only one of them can be latched down at a time. Pushbutton 22 closes the array of contacts 32, pushbutton 24 closes the array of contacts 34, pushbutton 26 closes contacts 36, and pushbutton 28 closes contacts 38.

Twelve input leads 8 and twelve output leads 18 are labeled by ordinal numbers M running from one to 12. When the pushbutton labeled 22 is depressed, the input labeled M = 1 is coupled to the output lead labeled M = 1, the input lead labeled M = 2 is coupled to the output lead labeled M = 2, and so on. When, in addition, the pitch changer and key selector are in their standard states, input and output leads labeled M = 1 to M = 12 carry the tones C,C flat, D,D flat, E,F,F flat, G,G flat, A,A flat, B respectively. Thus when pushbutton 22 is depressed the input and output leads are numbered in order of increasing pitch. These letter labels also are shown in FIG. 6.

Figure 10:
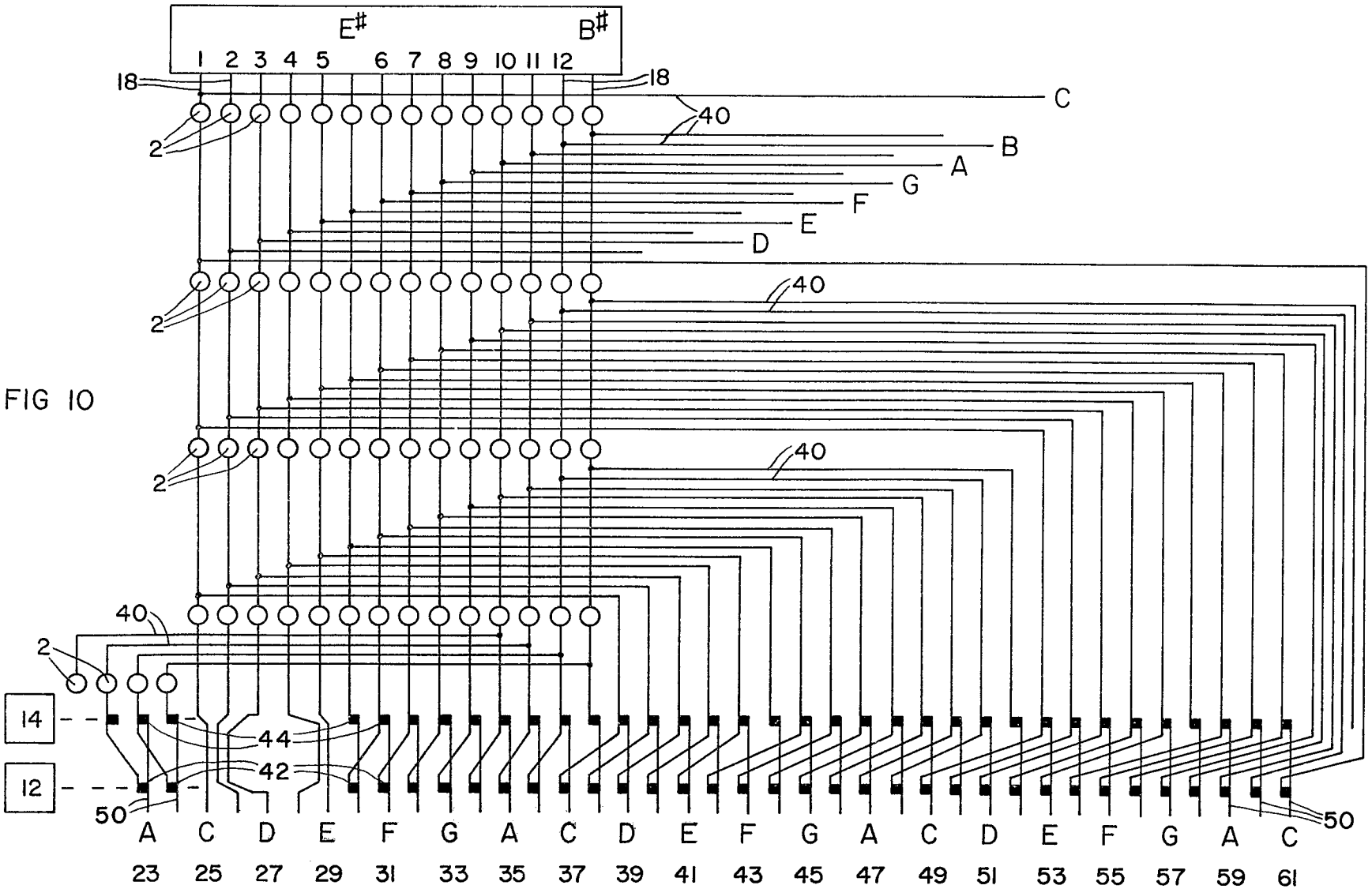
FIG. 10 shows my second scale selector switch for selecting between musical scales with different numbers of tones.

The same ordinal numbers M are used to identify the twelve chains of dividers to which these twelve output leads are connected respectively. Within each chain of dividers, successive stages are identified by ordinal numbers N running from one to seven. FIG. 10 shows the first four stages of the chains of dividers 2.

Secondary tone signals on output leads 40 from the chains of dividers 2 are numbered in order of increasing pitch by ordinal numbers K running from one to 61 inclusive. They are coupled to a second scale selector switch controlled by two pushbuttons 12, 14. The two pushbuttons are interlocked so that only one of them can be latched down at a time. Depression of pushbutton 12 closes the array of contacts 42; depression of pushbutton 14 closes the array of contacts 44.

Output leads 50 from the second scale selector switch, which are also the output leads from the whole scale selector apparatus, are labeled by the same ordinal numbers K that identify the secondary tones they carry in the first switch state of the whole scale selector apparatus, which state corresponds to depression of pushbuttons 22 of FIG. 6 and 12 of FIG. 10. These apparatus output leads are coupled individually to the set of digital switches, which are shown in FIG. 13.

Referring to FIG. 13, the same ordinal numbers K that identify the output leads 50 from the scale selector apparatus are also used to label the digital switches in order from left to right on the keyboard. Odd ordinal numbers K designate front digitals of the keyboard, even numbers designate the intermediate back digitals. In this first apparatus switch state, the odd-numbered chains of dividers and the odd-numbered digitals of the keyboard couple the tones of the whole tone scale. The conventional letter labels for these tones of the whole tone scale are C,D,E,F flat, G flat, A flat. The letter labels shown in FIGS. 10 and 13 are discussed later.

In this first apparatus switch state, secondary tones from the third stage of chains of divider circuits labeled 1 to 12 bear labels K from 37 to 48 respectively. These tones are coupled to apparatus output leads labeled 37 to 48 respectively, which are in turn coupled to digitals labeled 37 to 48 respectively. FIG. 11 shows how secondary tones from other stages of the twelve chains of frequency dividers are connected to apparatus output leads and digitals. The heading of this figure is the ordinal number M identifying the twelve different chains of dividers, and the tones they receive when pushbutton 22 of FIG. 6 is depressed. The first column lists the stage number N of the divider chains. The body of the table gives the ordinal number K that labels the apparatus output leads and the digitals of the keyboard. This listing of the connections may be expressed by the equation $K = M + 12(6 - N)$.

In the second apparatus switch state, the diatonic scale is played on the front digitals of the keyboard. When thus changing to a musical scale with a different number of tones per octave, it is necessary to switch the outputs from the chains of frequency dividers. For if the outputs from the chains of frequency dividers were permanently connected to the digitals with both twelve digitals per octave span and fourteen digitals per octave span, then most digitals would play two tones at once.

This second apparatus switch state is obtained by depression of pushbuttons 22 of FIG. 6 and 14 of FIG. 10. Tones from the third stage of the chains of dividers, which are therefore labeled 37 to 48 respectively, are coupled to apparatus output leads labeled 39 to 43 and 45 to 51 respectively. The ordinal numbers K identifying other apparatus output leads and digitals coupled to the different secondary tones are listed in FIG. 12. In FIG. 12, as in FIG. 11, the secondary tones are tabulated according to their divider chain origins when pushbutton 22 of FIG. 6 is depressed. Comparing the apparatus output lead numbers K for the same divider chain, it is seen that, in the second apparatus switch state, secondary tones labeled by ordinal numbers lower by 12 are coupled to apparatus output leads labeled by ordinal numbers lower by fourteen.

Other switch states of the scale selector apparatus may be obtained by depressing other pushbuttons of the first scale selector switch, shown in FIG. 6. Since these other switch states all produce six-tone scales on the front digitals of the keyboard, it is necessary that the second scale selector switch have the pushbutton 12 of FIG. 10 depressed.

When the second scale selector switch of FIG. 4 is set for hexatonic scales, the tones produced by the four different pushbuttons of FIG. 6 are shown in Table 1. The headings of the columns are the numerical labels of the output leads 18. Traditional letter labels are used for the tones.

Table 1

| Push Button | Scale | 1 | 2 | 3 | 4 | 5 | 6 | 7 | 8 | 9 | 10 | 11 | 12 |
|---|---|---|---|---|---|---|---|---|---|---|---|---|---|
| 22 | Whole Tone | C | C | D | D | E | F | F | G | G | A | A | B |
| 24 | Hexachord | C | C | D | D | E | F | F | G | G | A | A | B |
| 26 | Hexachord | C | C | D | D | E | A | F | F | G | G | A | B |
| 28 | 1-2-3 | C | C | D | D | E | F | F | G | G | A | A | B |

Pushbutton 22 selects a first set of six primary tone signals, constituting the whole tone scale, to be transmitted on the six odd-numbered apparatus output leads and the six odd-numbered chains of frequency divider circuits. This sequence of tones C,D,E,F flat, G flat, A flat, is characterized by the sequence of intertone intervals 2-2-2-2-2-2 semitones. Their octave-related tones are played by the front digitals of the keyboard. Intermediate tones are transmitted on the six even-numbered apparatus output leads, and played by the back digitals of the keyboard.

Pushbutton 24 selects a second set of six primary tone signals, constituting the major mode of the hexachord scale, to be transmitted on the six odd-numbered apparatus output leads and chains of frequency dividers. This sequence of tones C,D,E,F,G,A is characterized by the sequence of intertone intervals 2-2-1-2-2-3 semitones. Their octave-related tones are played by the front digitals of the keyboard.

For the front digitals to play the hexachord scale, it is sufficient that the sequence of six odd-numbered chains of frequency dividers transmit any one of the cyclic modes of the hexachord scale. The six cyclic modes are defined by the sequences of intertone intervals:

2-2-1-2-2-3 semitones, (major)
3-2-2-1-2-2 semitones, (minor)
2-3-2-2-1-2 semitones,
2-2-3-2-2-1 semitones, (subdom.)
1-2-2-3-2-2 semitones,
2-1-2-2-3-2 semitones.

Tones intermediate to the tones of the hexachord scale are transmitted on the six even-numbered apparatus output leads and played on the back digitals of the keyboard.

Pushbutton 26 produces the same hexachord scale on the front digitals, but with different connections to the back digitals, so that eleven tones per octave span have pitches increasing from left to right on the keyboard. I prefer this tonal arrangement on the keyboard for teaching beginners.

Unfortunately, of all hexatonic scales, only the whole tone scale on the front digitals can have all twelve tones of the equitempered scale positioned on my keyboard in their natural order. The hexachord scale arrangement preferred for mature musicians has the F flat, G flat, and A flat tones (traditional notation) positioned on the keyboard to the left of the F, G, A digitals respectively. This permutation of tones is obtained by pushbutton 24, and it is shown in Table 1.

Pushbutton 28 produces a hexatonic scale including A flat on the front digitals, with only two back digitals per octave span positioned out of their natural order. This scale may be considered to be a diminished diatonic scale, obtained by omitting the E tone from one of the cyclic modes of the diatonic scale.

For the front digitals of the keyboard to play this scale, it is sufficient that the sequence of six odd-numbered chains of frequency dividers transmit any one of its six cyclic modes. The six cyclic modes of this scale are defined by the six sequences of intertone intervals:

2-2-1-2-3-2 semitones,
2-2-2-1-2-3 semitones,
3-2-2-2-1-2 semitones,
2-3-2-2-2-1 semitones,
1-2-3-2-2-2 semitones,
2-1-2-3-2-2 semitones.

The conventional music notation is based on the seven tones of the C major mode of the diatonic scale. Music in other keys or modes is notated in terms of the tones of the C major mode by means of a key signature placed at the beginning of each line of music. For example, the A major mode is notated in terms of the C major tones by means of a key signature with three sharps, as shown in FIG. 15. As another example, the C minor mode is notated in terms of the C major tones by means of a key signature containing three flats (B flat, E flat, A flat). My organ has a switch which physically activates these key signatures. This key signature actuator or "key selector" is shown in FIGS. 16 and 17, it is described later.

The method of diatonic key signatures may be extended to hexatonic tone signatures that specify not only different keys or modes, but also different musical scales. As explained in my copending patent application no. 553,798, the six tones of the whole tone scale provide a most satisfactory basis for such an extended system of notation. The whole tone notation is compared with the diatonic notation (for the same tones) in Table 2.

Table 2

| Notation | 1 | 2 | 3 | 4 | 5 | 6 | 7 | 8 | 9 | 10 | 11 | 12 |
|---|---|---|---|---|---|---|---|---|---|---|---|---|
| Diatonic | C | C | D | D | E | F | F | G | G | A | A | B |
| Whole Tone | C | C | D | D | E | F | F | G | G | A | A | C |

Thus tones of the hexachord scale may be written with the whole tone scale sign of FIG. 3, together with a tone signature having three flats. For the C major hexachord scale, the three flats are F flat, G flat, A flat. The tone signature calling for these tone corrections is shown in FIG. 8. When the keyboard player encounters the whole tone scale sign with the tone signature of FIG. 8, he depresses pushbutton 24. This actuates the tone corrections called for in the hexachord tone signature. In this sense scale selector may be termed a "tone signature actuator".

If in the music the player comes to a natural sign, he plays it as a flat, to the left of the indicated digital. On the other hand, a singer, or musician playing an instrument without a scale selector, would read the natural sign to be sung or played a semitone higher than the signature-flatted note.

Pushbuttons 24 and 26 produce the hexachord scale on the front digitals, with two different assignments of tones to the back digitals. Pushbutton 28 produces a musical scale characterized by the intertone intervals 2-2-1-2-3-2. A tone signature for this scale is shown in FIG. 9, in whole tone notation. Whole tone notation is preferred to hexachord notation, except for the particular permutation of tones corresponding to pushbutton 26. In this case the hexachord scale sign is used alone, without a tone signature. The letter labels shown in FIGS. 10 and 13 correspond to the whole tone letter notation for the tones transmitted in the first apparatus switch state. They also correspond to the conventional letter labels for the tones transmitted in the third apparatus switch state, when the hexachord is being played. The sequence of six letter labels corresponds to the hexatonic keyboard labeling shown in FIG. 1.

Each of the chains of frequency dividers indicated in FIGS. 4 and 10 is an integrated circuit package of type SCL4024A, manufactured by Solid State Scientific, Inc. This integrated circuit package has a single audio input and seven stages with outputs at frequencies below the input frequency by factors of 2,4,8,16,32, 64, and 128. Thus the chain whose input is G at 3136 Hz produces outputs of G at frequencies of 1568 Hz, 784 Hz, 392 Hz, etc. for the lower octaves of the organ.

Referring again to FIG. 6, input leads 8 may be connected to the tone generator circuits directly, or via other switches, as shown in FIG. 4. The intervention of the pitch changer switch has no effect except to raise or lower the absolute pitch of the musical output. The intervention of the key selector switch will have no effect when it is in its standard position.

When the key selector switch is not in its standard position, but is in use to activate a diatonic key signature, it requires two extra channels for tone signals between the key selector and the digital switches. Thus, in FIG. 10, extra leads 18, labeled E sharp and B sharp, are connected to E flat and B flat chains of frequency divider circuits 2. Outputs from these frequency divider circuits pass through the second scale selector switch to the digital switches when the diatonic pushbutton 14 is depressed. On the other hand, when the hexatonic pushbutton 12 is depressed, outputs from the E sharp and B sharp chains of frequency dividers are not coupled to the digitals.

Diatonic key signatures of the type encountered when playing the diatonic scale are shown in FIGS. 14 and 15. FIG. 14 calls for the two natural tones B and E to be routinely lowered one semitone, in order that the major mode of the diatonic scale shall start on the B flat tone. FIG. 15 calls for the three natural tones F, C and G to be routinely raised one semitone, in order that the major mode of the diatonic scale shall start on the A tone. This method that the composer uses to set the absolute pitch of his music places a severe burden on an inexperienced player.

To relieve this burden, I have provided a key selector switch, shown in FIG. 16, which can be set to perform the tone substitutions called for by the composer in his key signatures.

Referring to FIG. 16, when the pitch changer switch is in its standard position, the key selector receives twelve frequencies ranging from C sharp at 2217 Hz to C at 4186 Hz. Two more lower frequencies at 1976 Hz and 2093 Hz are obtained by means of frequency division using dual flip-flop 16, of the aforementioned CD4027Ae type.

Referring still to FIG. 16, leads 70 carrying fourteen tone signals are connected to a first linear array of stationary contacts 72, uniformly spaced in a straight line. A second linear array of stationary contacts 73, equally spaced in a parallel line, is connected to fourteen output leads 71.

Sliding along the first linear array of stationary contacts 72 is a first linear array of ganged movable contacts 74, mounted on carriage 64 which moves in a direction parallel to the linear array of stationary contacts 72.

Sliding along the second linear array of stationary contacts 73 is a second linear array of ganged movable contacts 75, also mounted on carriage 64.

The input leads 70, stationary 72,73, output leads 71, and movable carriage 64 are mounted on a common stationary circuit board 65.

As is usual with multiposition switches, a detent mechanism and stops are provided (not shown) to ensure tat there are just 15 stable operating positions for the carriage, corresponding to the 15 key signatures ranging from seven flats to seven sharps. The carriage is moved by means of handle 66. A cross sectional view of the carriage, showing the spring contacts, is shown in FIG. 17.

Referring again to FIG. 16, movable conductors 80 connect members of the first linear array of movable contacts to members of the second linear array of movable contacts. The pattern of interconnections results in a diatonic scale corresponding to the lower digitals of the keyboard. As these interconnections move up or down the switch, the corresponding diatonic scale moves up or down the keyboard. In FIG. 16, the carriage is shown in its standard position, which corresponds to the key of C; labeling of the fourteen output leads corresponds to this standard position. The two extra output leads labeled E sharp and B sharp correspond to the two extra upper digitals per octave span of the keyboard, shown in FIG. 7.

Referring to FIG. 16, when the movable assembly moves from its standard position 2,4,6 steps to the right, the number of sharps is 2,4,6 and a major mode is formed 2,4,6 semitones above the key of C. Similarly, when the movable assembly moves from its standard position 2,4,6 steps to the *left*, the number of *flats* is 2,4,6 and a major mode is formed 2,4,6 semitones *below* the key of C.

On the other hand, when the movable assembly moves from its standard position 1,3,5,7 steps to the right, 1,3,5,7 sharps are made, but a major mode is formed 7,9,11,13 semitones above the key of C; when the movable assembly moves 1,3,5,7 steps to the *left*, 1,3,5,7 *flats* are made, but a major mode is formed 7,9,11,13 semitones below the key of C. When the key selector apparatus is not being used, it should be left in its standard position, corresponding to the key of C.

Operation of the pitch changing switch does not necessarily affect the naming of the musical tones that result. For example, in FIG. 1, the G digital may be struck, and the resulting tone may be called G regardless of which pitch changer state is activated. When a pitch changer is available, it is more helpful to describe a tone by its position in the movable C major scale, rather than by its absolute pitch. The two descriptions coincide when the pitch changer is in its standard state.

While I have described switching apparatus in a particular organ, it is to be understood that the invention may be used in other environments. In particular, instead of the apparatus output leads being coupled directly to digital switches mounted on the digitals, the apparatus output leads may be coupled to solid state switches that are remotely controlled by the digital switches.

Furthermore, since the first and second selector switches switch cooperate, each apparatus switching operation can be divided in many of different ways between the two switches. For example, when the diatonic scale is to be used, it could be required that the first switch be in a hexachord condition, instead of the whole tone condition.

If the input connections to any pair of divider chains A and B are interchanged by the first switch, and the second switch interchanges the output connections from each chain A with corresponding output connections from chain B, then the same overall result will be obtained. The invention encompasses all of these equivalent permutations of the chains of frequency divider circuits which can occur during the switching from one musical scale to another.

Without departing from the spirit of the invention, the front digitals can play musical scales with as few as five tones or as many as eight tones per octave.

I claim:

1. A method for selecting a single hexatonic musical scale from a plurality of hexatonic musical scales to be played on an electronic musical instrument, the improvement comprising:

electronically generating at least first and second sets of six primary tone signals, corresponding respectively to the whole tone scale and an irregular hexatonic scale, the members of said first set of primary tone signals being arranged in a first sequence in order of increasing pitch, with constant intertone intervals of two semitones between consecutive members of said sequence, the members of said second set of primary tone signals being arranged in a second sequence in order of increasing pitch with at least one intertone interval of one semitone, at least one intertone interval of two semitones, at least one intertone interval as large as three semitones, and a maximum interval of eleven semitones between the first and last members of the sequence, arranging six chains of frequency divider circuits in a predetermined sequence, each chain of frequency divider circuits having a single audio input lead and a plurality of cascaded frequency divider circuits, each circuit with its individual output lead, successive cascaded circuits producing the input musical tone in descending octave relationship, selectively coupling one of said sequences of six primary tone signals to the six inputs of said predetermined sequence of six chains of cascaded frequency divider circuits, consecutive members of said sequence of primary tone signals being coupled to consecutive members of said predetermined sequence of chains of frequency divider circuits in order of increasing pitch.

2. The method recited in claim 1 in which said second sequence of primary tone signals is in the class of diminished diatonic scales, each diminished diatonic scale being derived from the seven-tone diatonic scale by the omission of one of its tones.

3. The method of claim 2 in which said second sequence of six primary tone signals is defined by one of the following sequences of intertone intervals:

2-2-1-2-2-3 semitones, 2-2-1-2-3-2 semitones,
3-2-2-1-2-2 semitones, 2-2-2-1-2-3 semitones,
2-3-2-2-1-2 semitones, 3-2-2-2-1-2 semitones,
2-2-3-2-2-1 semitones, 2-3-2-2-2-1 semitones,
1-2-2-3-2-2 semitones, 1-2-3-2-2-2 semitones,
2-1-2-2-3-2 semitones, 2-1-2-3-2-2 semitones.

4. Improved apparatus for playing in different musical scales on an electronic musical instrument having:

a set of primary tone generator circuits respectively arranged to provide tones of the equitempered scale, a set of chains of frequency divider circuits providing secondary tones derived from said primary tone generator circuits by frequency division, each chain having a single input lead and a plurality of cascaded frequency divider circuits, each circuit with its individual output lead, successive output leads producing the input musical tone in descending octave relationship, apparatus output leads providing secondary tone outputs, the improvement comprising:

first switching means for selecting between musical scales with the same number of tones per octave, said first switching means coupling individual primary tone generator circuits to individual input leads of said chains of frequency divider circuits, second switching means for selecting between musical scales with different numbers of tones per octave, said second switching means coupling individual output leads from said chains of frequency divider circuits to individual apparatus output leads, said apparatus having at least three switch states corresponding to three different musical scales, including at least first and second switch states providing musical scales with different numbers of tones per octave, the number of tones per octave being in the range five to eight inclusive.

5. Apparatus as recited in claim 4 in which:

said primary tone generator circuits, being at least twelve in number, provide a continuous sequence of twelve primary tones, with intertone intervals of a single semitone between consecutive primary tones of the sequence, said first and second switch states correspond respectively to the whole tone scale and the diatonic scale, in said first and second switch states, said twelve primary tone generator circuits being coupled individually to the inputs of twelve of said chains of frequency divider circuits so as to provide a continuous sequence of a plurality of octaves of secondary tones, with intertone intervals of a single semitone between consecutive secondary tones of the sequence, said secondary tones being labeled by consecutive ordinal numbers K in order of increasing pitch, in said first switch state, said continuous sequence of secondary tones being coupled in succession to said apparatus output leads, said apparatus output leads being permanently labeled with ordinal numbers identical to those of the tones coupled to them individually in said first switch state, in said second switch state, tones labeled 37 to 48 inclusive being coupled individually to apparatus output leads labeled respectively 39 to 43 inclusive and 45 to 51 inclusive, apparatus output leads labeled 38 and 44 being redundant, tones labeled by ordinal numbers K lower by 12 being coupled to apparatus output leads labeled by ordinal numbers lower by fourteen.

6. Improved apparatus for playing in different musical scales on an electronic musical instrument having:

a set of primary tone generator circuits respectively arranged to provide tones of the equitempered scale, a set of chains of frequency divider circuits providing secondary tones derived from said primary tone generator circuits by frequency division, each chain having a single signal input lead and a plurality of cascaded frequency divider circuits, each circuit with its individual output lead, successive output leads producing the input musical tone in descending octave relationship, a continuous keyboard having a plurality of manually actuated alternately disposed front and back digitals, the improvement comprising:

first switching means for selecting between musical scales with the same number of tones per octave, said first switching means coupling individual primary tone generator circuits to individual input leads of said chains of frequency divider circuits, second switching means for selecting between musical scales with different numbers of tones per octave, said second switching means coupling individual output leads from said chains of frequency divider circuits to individual digitals of said keyboard, said apparatus having at least three switch states corresponding to three different musical scales, including at least first and second switch states providing musical scales with different numbers of tones per octave, the number of tones per octave being in the range five to eight inclusive.

7. Apparatus as recited in claim 6 in which:

said primary tone generator circuits, being at least twelve in number are arranged in a continuous sequence in order of increasing pitch, with intertone intervals of a single semitone between consecutive numbers of said sequence, said 12 primary tone generator circuits being labeled in order of increasing pitch by ordinal numbers M running from one to twelve inclusive, the stages of each chain of cascaded frequency divider circuits being labeled in order of succession by consecutive ordinal numbers N, the digitals of said keyboard being labeled successively from left to right by consecutive ordinal numbers K, in said first switch state, in that chain of frequency divider circits which has the Mth primary tone generator circuit coupled to its input, the output from its Nth stage being coupled to a digital labeled by the ordinal number $K = M + 12(6-N)$, in said second switch state, said set of chains of frequency divider circuits being labeled by the same ordinal numbers as those of said individual primary tone generator circuits coupled to them, the outputs from the third stage of said chains of cascaded frequency divider circuits labeled from one to twelve inclusive being coupled to digitals labeled respectively 39 to 43 inclusive and 45 to 51 inclusive, digitals labeled 38 and 44 being redundant, outputs from successive stages of said chains of frequency divider circuits being labeled lower by successive decrements of 14.

* * * * *

UNITED STATES PATENT AND TRADEMARK OFFICE

CERTIFICATE OF CORRECTION

PATENT NO. : 4,009,633

DATED : Mar. 1, 1977

INVENTOR(S) : Donald K. Coles

It is certified that error appears in the above-identified patent and that said Letters Patent are hereby corrected as shown below:

Column 5, line 34, "C flat" should read --C sharp-- .

Column 6, line 47, "F flat, G flat, A flat." should read --F#, G#, A#.-- .

Column 7, line 35, Table 1 should read

--Table 1

| Push Button | Scale | 1 | 2 | 3 | 4 | 5 | 6 | 7 | 8 | 9 | 10 | 11 | 12 | |
|---|---|---|---|---|---|---|---|---|---|---|---|---|---|---|
| 22 | Whole Tone | C | C# | D | D# | E | F | F# | G | G# | A | A# | B | |
| 24 | Hexachord | C | C# | D | D# | E | F# | F | G# | G | A# | A | B | |
| 26 | Hexachord | C | C# | D | D# | E | A# | F | F# | G | G# | A | B | |
| 28 | 1-2-3 | C | C# | D | D# | E | F# | F | G# | G | A | A# | B | --. |

Column 7, line 50, "F flat, G flat, A flat," should read --F#, G#, A#,-- .

Column 8, line 23, "F flat, G flat, and A flat" should read --F#, G#, and A#-- .

UNITED STATES PATENT AND TRADEMARK OFFICE

CERTIFICATE OF CORRECTION

PATENT NO. : 4,009,633

DATED : Mar. 1, 1977

INVENTOR(S) : Donald K. Coles

It is certified that error appears in the above-identified patent and that said Letters Patent are hereby corrected as shown below:

Column 9, line 10, Table 2 should read

--Table 2

| Notation | 1 | 2 | 3 | 4 | 5 | 6 | 7 | 8 | 9 | 10 | 11 | 12 |
|---|---|---|---|---|---|---|---|---|---|---|---|---|
| Diatonic | C | C# | D | D# | E | F | F# | G | G# | A | A# | B |
| Whole Tone | C | C# | D | D# | E | F | F | G | G | A | A | C |

-- .

Column 9, line 26, after "sense" insert --my-- .
Column 10, line 4, "E flat and B flat" should read --E# and B#-- ;
line 60, "tat" should read --that-- .

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*